US006659797B2

(12) United States Patent
Ichio

(10) Patent No.: US 6,659,797 B2
(45) Date of Patent: Dec. 9, 2003

(54) CONNECTOR WITH RESILIENTLY DEFLECTABLE LOCK ARM

(75) Inventor: Toshifumi Ichio, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/083,056

(22) Filed: Feb. 26, 2002

(65) Prior Publication Data

US 2002/0123260 A1 Sep. 5, 2002

(30) Foreign Application Priority Data

Mar. 2, 2001 (JP) ..... 2001-059077
Jan. 31, 2002 (JP) ..... 2002-024577

(51) Int. Cl.[7] ..... H01R 13/40
(52) U.S. Cl. ..... 439/595
(58) Field of Search ..... 439/595, 752, 439/744

(56) References Cited

U.S. PATENT DOCUMENTS 4,973,268 A * 11/1990 Smith et al. ..... 439/595
5,692,929 A 12/1997 Hoffmann ..... 439/752
6,193,551 B1 2/2001 Yamamoto et al. ..... 439/595

FOREIGN PATENT DOCUMENTS

JP 01-177877 12/1989
JP 03-205770 9/1991

* cited by examiner

*Primary Examiner*—Renee Luebke
*Assistant Examiner*—Ann McCamey
(74) *Attorney, Agent, or Firm*—Anthony J. Casella; Gerald E. Hespos

(57) ABSTRACT

A connector has a housing (10) with a terminal accommodating portion (11) formed with cavities (19) in which terminal fittings (13) can be accommodated. A receptacle (12) surrounds the terminal accommodating portion (11) and a lock arm (31) is coupled to the receptacle (11) by supports (35). This lock arm (31) is resiliently deformable like a seesaw with the supports (35) as a point of support, and can hold a housing (80) of a male connector fitted between the terminal accommodating portion (11) and the receptacle (12) in its connected state.

13 Claims, 17 Drawing Sheets

CONNECTOR WITH RESILIENTLY DEFLECTABLE LOCK ARM

BACKGROUND OF THE INVENTION

1. Field of the Invention

The present invention relates to a connector.

2. Description of the Related Art

A connector with watertight characteristics is disclosed in FIG. 24 herein. The connector has terminal fittings 1 mounted in a terminal accommodating portion 2. The terminal accommodating portion 2 is surrounded by a receptacle 3, and together the terminal accommodating portion 2 and the receptacle 3 define a housing 4. A rubber ring 5 is mounted on the outer surface of the terminal accommodating portion 2.

A mating housing can be inserted between the terminal accommodating portion 2 and the receptacle 3. The mating housing squeezes the rubber ring 5 and hence provides a watertight fit between the housings. The housing 4 further includes a lock arm 6 with front and rear ends and a lock hole 7 formed near the front end. Supports 8 connect a longitudinally central portion of the lock arm 6 to the upper surface of the terminal accommodating portion 2. The supports 8 act as a pivot point and permit the lock arm 6 to deform resiliently up and down like a seesaw. Thus, the lock arm 6 can be deformed so that the lock hole 7 engages a lock on the mating housing.

A trend toward miniaturization exists throughout the electrical connector industry, and hence a demand exists to make the above-described connector shorter. This necessarily would require shortening the terminal accommodating portion 2, which extends substantially the entire length of the connector. The rubber ring 5 and a retainer 9 for locking the terminal fittings 1 in the terminal accommodating portion 2 are disposed between the front end of the terminal accommodating portion 2 and the supports 8. As a result, there are few options for shortening the housing 4 at locations on the terminal accommodating portion 2 forward of the supports 8.

The terminal accommodating portion 2 conceivably could be shortened at locations rearward of the supports 8. However, the rear end of the lock arm 6 also would have to be shortened to ensure that the lock arm 6 does not project backward beyond the terminal accommodating portion 2. As a result, the supports 8 would be near the rear end of the lock arm 6, and a large force would be required to press the rear end of the lock arm 6 for detaching the two housings. Therefore, there has been a limit in making the connector smaller.

The present invention was developed in view of the above problem and an object of the invention is to provide a connector that can be made smaller.

SUMMARY OF THE INVENTION

The invention is directed to a connector with a housing that comprises a terminal accommodating portion and a receptacle that surrounds at least part of the terminal accommodating portion. At least one terminal fitting is insertable into the terminal accommodating portion from behind. A resiliently deformable lock arm is provided for holding a mating housing between the terminal accommodating portion and the receptacle. The lock arm is coupled to the receptacle by at least one support and is resiliently deformable about the support as pivot point. The support preferably projects laterally from a lateral side of the lock arm.

The coupling of the lock arm to the receptacle at the support improves the options for locating the support along forward and backward directions. Thus, the supports do not need to be moved back even if the terminal accommodating portion is shortened. Therefore, the connector can be made shorter without affecting operability of the connector.

An auxiliary support may be provided for coupling a rear end of the lock arm to the terminal accommodating portion. The lock arm is supported resiliently by the auxiliary support, and therefore the housings can be held in a mated condition with an enhanced force.

The auxiliary support may be widened gradually toward the terminal accommodating portion. Accordingly, the strength of the auxiliary support is enhanced.

The auxiliary support preferably is provided such that wires projecting from the terminal accommodating portion are substantially prevented from entering between the terminal accommodating portion and the lock arm.

The support preferably is at an intermediate longitudinal position along the lock arm, and preferably is slightly behind the longitudinal center of the lock arm.

The support may gradually widen toward the receptacle. Accordingly, the strength of the support is enhanced.

The rear end of the lock arm preferably defines an operable portion. Further, the support preferably is coupled to the operable portion by a coupling portion. Accordingly, a resilient force created when the resilient lock arm is deformed is enhanced.

Most preferably, an excessive-displacement restraining means is provided for preventing the lock arm from being displaced excessively.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
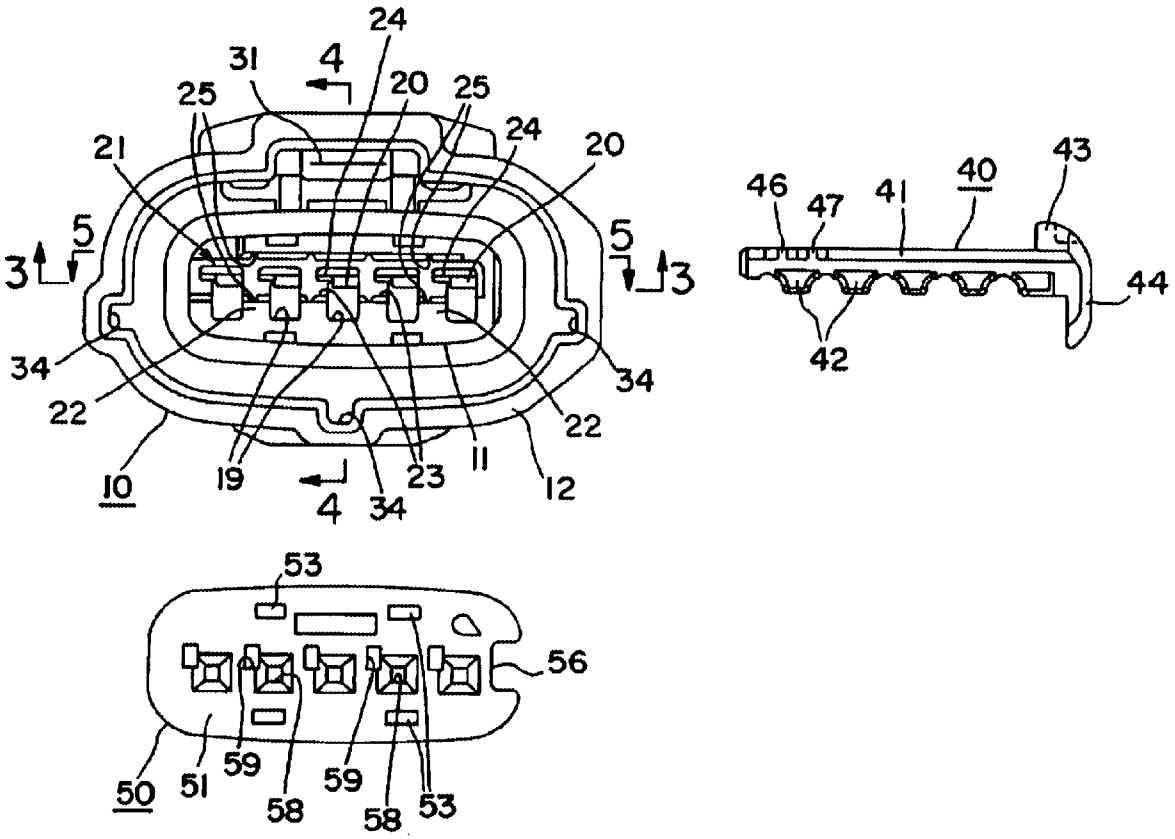
FIG. 1 is a front view of a housing, a holder and a retainer according to one embodiment of the invention.
Figure 3:
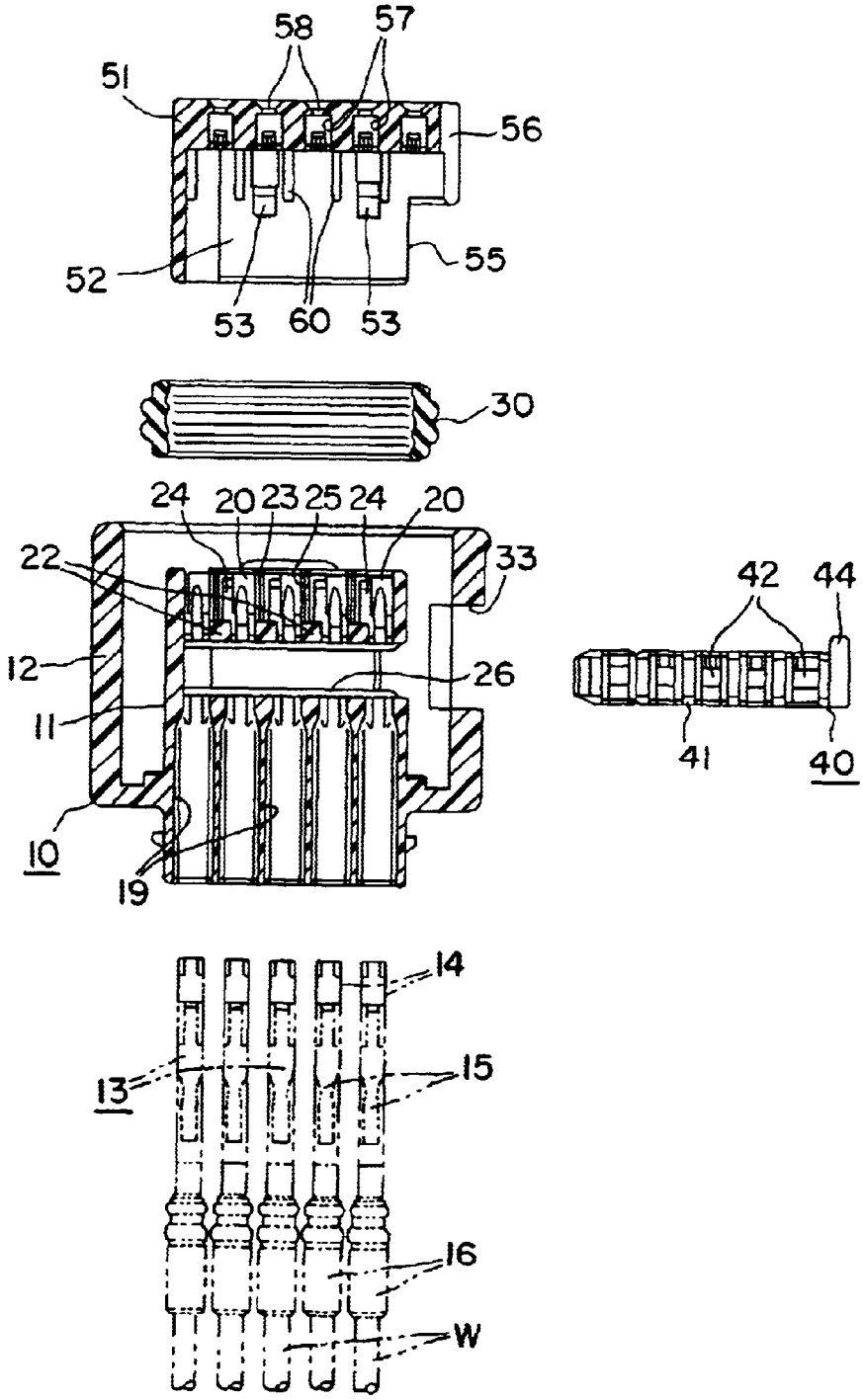
FIG. 3 is a section along 3—3 of FIG. 1 showing an exploded state of a female connector.
Figure 4:
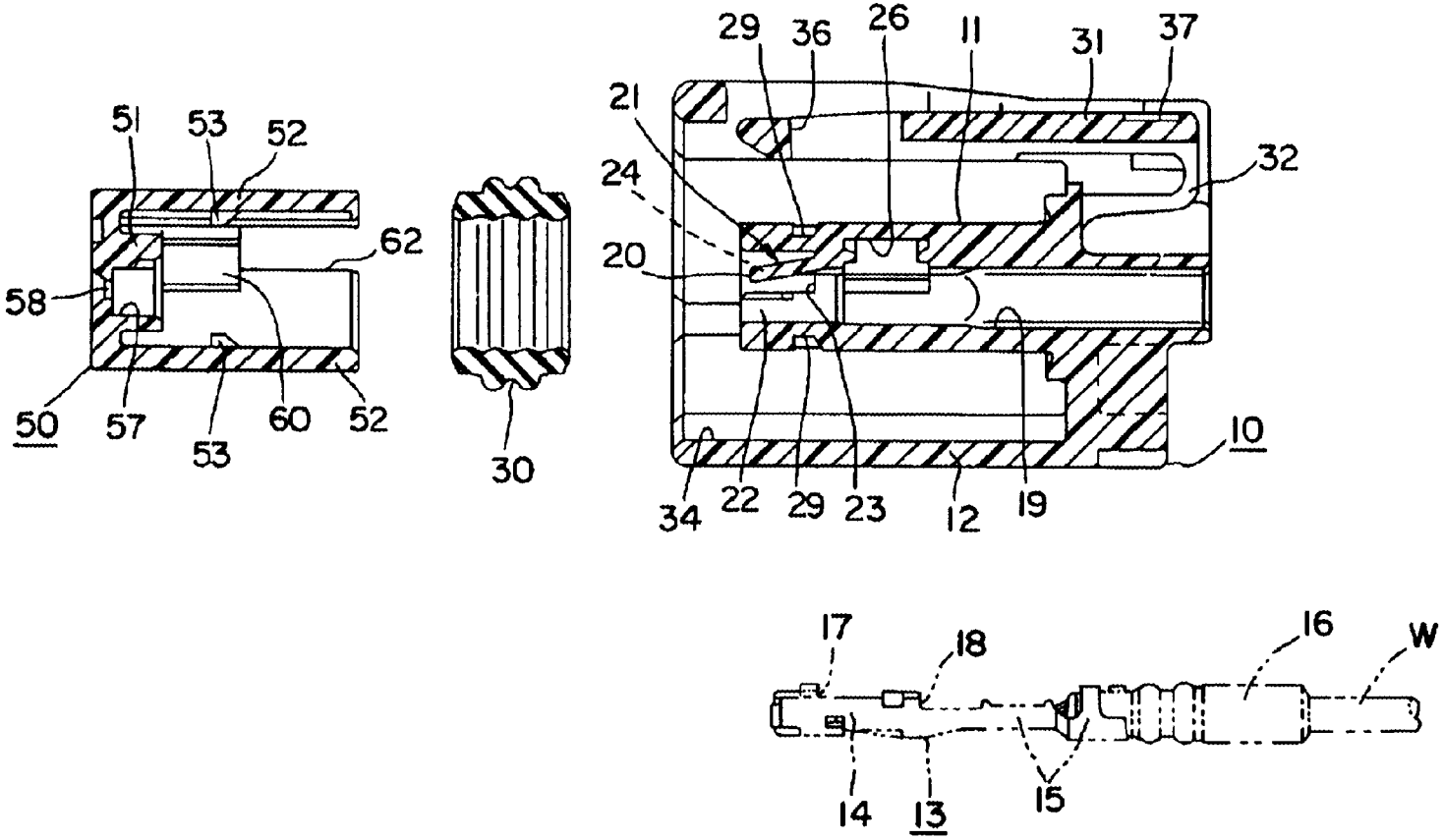
FIG. 4 is a section along 4—4 of FIG. 1 showing the exploded state of the female connector.

A female connector in accordance with the invention includes a housing 10, as shown in FIG. 1. The housing 10 is made of a synthetic resin and includes a terminal accommodating portion 11. The housing also includes a receptacle 12 that surrounds a front end of the terminal accommodating portion 11, as shown in FIGS. 3 and 4. The receptacle 12 is a forwardly open rectangular tube that is coupled to the terminal accommodating portion 11 by a coupling portion that bulges out near the rear of the terminal accommodating portion 11. A mating male connector can be inserted between the receptacle 12 and the terminal accommodating portion 11 from the front, as described and illustrated below. The terminal accommodating portion 11 accommodates terminal fittings 13, each of which has a substantially box-shaped connecting portion 14 and a barrel 15 that is crimped into connection with an end of a wire W. A rubber plug 16 is fitted on an end of the insulation coating of the wire W and is crimped by the barrel 15.

Five cavities 19 are arrayed laterally in the housing 10 and are dimensioned to receive the terminal fittings 13 from behind, as shown in FIG. 3. A front half of each cavity 19 has a substantially rectangular cross section that conforms to the shape of the connecting portion 14 of the terminal fitting 13. A rear half of each cavity 19 has a circular cross-section that conforms to the shape of the rubber plug 16. Thus, the rubber plug 16 is held close to the inner surface of the cavity 19 to protect the inside of the cavity 19 from water.

A lock 20 is cantilevered from an upper front of each cavity 19 and intersects an inserting direction of the terminal fitting 13, as shown in FIG. 4. The lock 20 is deformed resiliently in a deformation direction and into a deformation permitting space 21 during insertion of the terminal fitting 13 into the cavity 19. However the lock 20 is restored resiliently substantially to its original shape when the terminal fitting 13 reaches a proper depth and engages a projection 17 on the upper surface of the engaging portion 14. At this time, the terminal fitting 13 is accommodated in the cavity 19 and its front end projects forward from the terminal accommodating portion 11.

The front halves of adjacent cavities 19 are partitioned by partition walls 22, each of which is slightly narrower than the front half of the corresponding cavity 19. Each partition wall 22 has a notch 23 that opens forwardly from the base end of the lock 20. Each notch 23 is disposed at the upper part of the partition wall 22 and extends over more than half the height of the partition wall 22, as shown in FIG. 1. Thus, each notch 23 extends from the upper end of the partition wall 22 to a position below the bottom end of the lock 20. Substantially V-shaped positioning grooves 25 are formed in the upper and lower surfaces of the notches 23.

An unlocking piece 24 is coupled to a side surface of the lock 20 over substantially its entire length and projects from the back end of each notch 23. The unlocking piece 24 can be pressed with a jig to disengage the lock 20 from the terminal fitting 13. The unlocking piece 24 is about half as wide as the respective notch 23.

Figure 5:
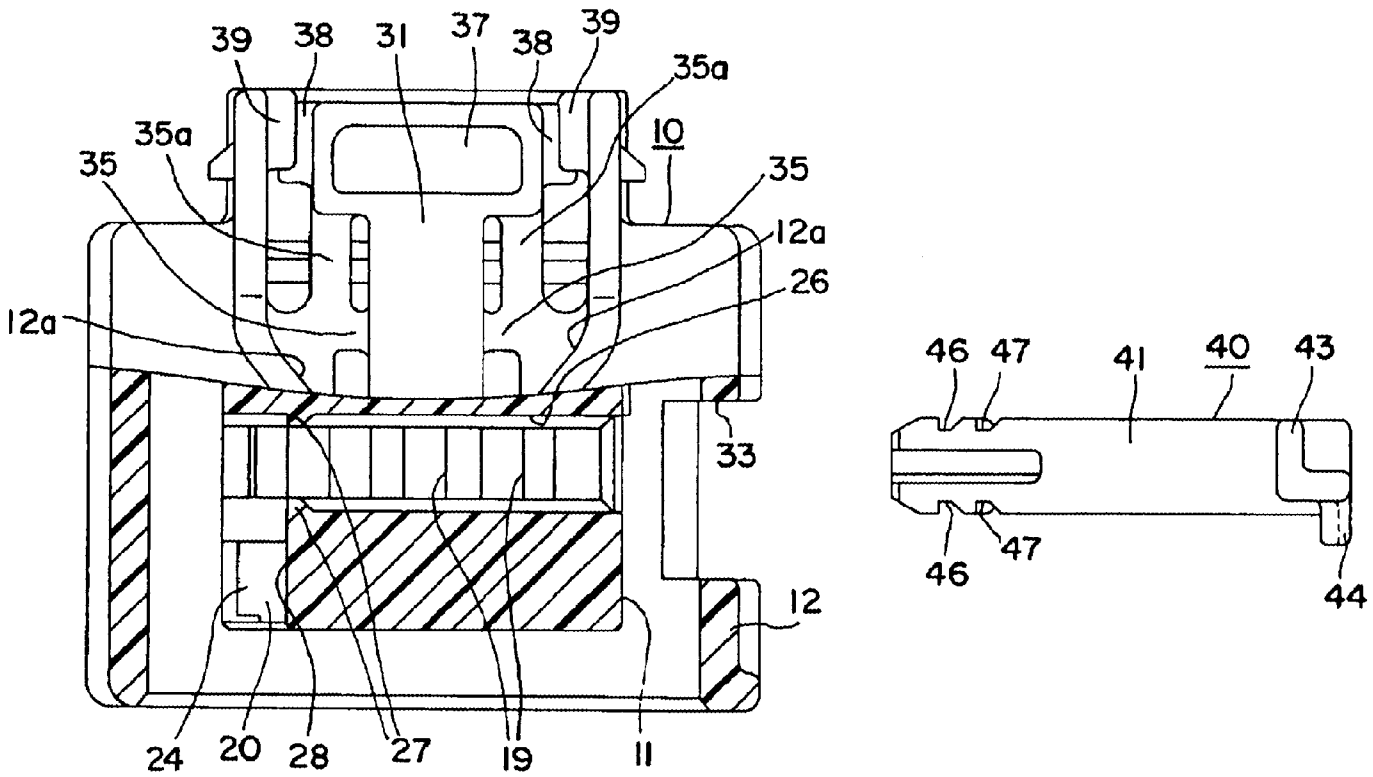
FIG. 5 is a section along 5—5 of FIG. 1 showing the housing and the retainer.

A retainer mount hole 26 penetrates the terminal accommodating portion 11 transversely and communicates with the cavities 19 at a position slightly behind the locks 20, as shown in FIGS. 3 and 4. Front and rear holding projections 27 project at the rear side of the retainer mount hole 26, as shown in FIG. 5, and a mold removal hole 28 opens forwardly at the front side of the holding projections 27 for forming the back end surfaces of the holding projections 27. Two laterally-extending holding grooves 29 are formed in each of the upper and lower surfaces of the terminal accommodating portion 11, as shown in FIG. 4, and open sideways. Slanted surfaces are formed at each of the upper and lower sides of the front end surface of the terminal accommodating portion 11.

A rubber ring 30 is fitted on the outer surface of the terminal accommodating portion 11 and can be squeezed tightly between the terminal accommodating portion 11 and the male connector to provide a watertight fit between the connectors.

A lock arm 31 is provided substantially at a widthwise center of the upper part of the receptacle 12 for holding the male connector connected. The lock arm 31 has its rear end coupled to the terminal accommodating portion 11 by two support arms 32 and has opposite lateral edges partially coupled to the receptacle 12 as shown in FIG. 5. Thus the lock arm 31 is vertically resiliently displaceable, as described and illustrated below.

Figure 2:
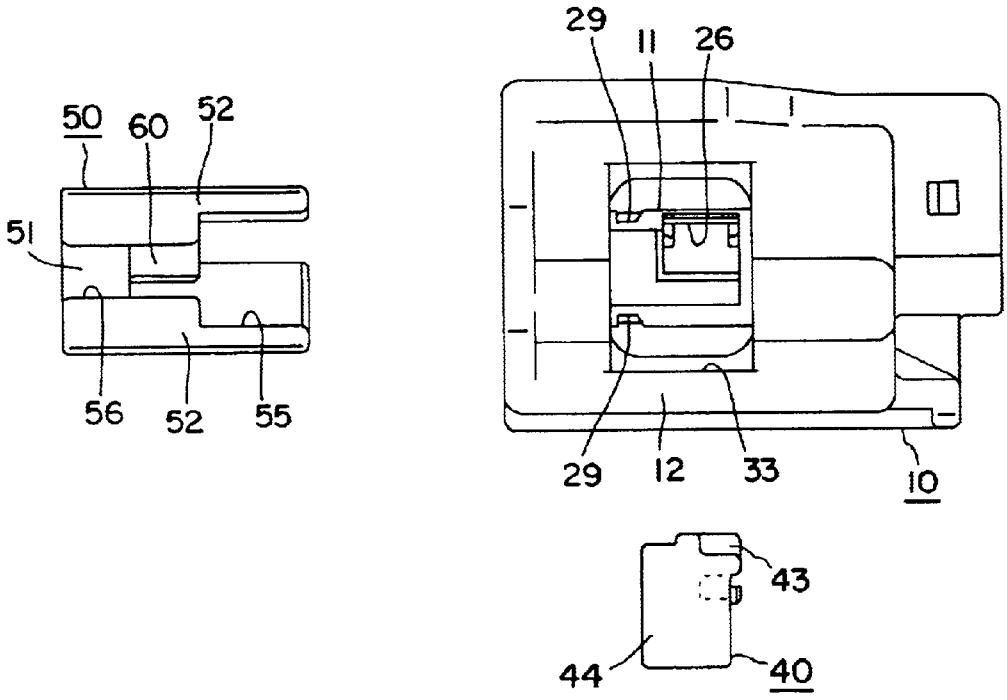
FIG. 2 is a side view of the housing, the holder and the retainer.

A retainer insertion hole 33 opens at the right side of the receptacle 12 in FIG. 5. As shown in FIG. 2, the retainer mount hole 26 of the terminal accommodating portion 11 and the holding grooves 29 are exposed to the outside through the retainer insertion hole 33. The retainer insertion hole 33, the retainer mount hole 26 and the holding grooves 29 are formed by the same mold when the housing 10 is molded. Opposite sides and the bottom of the receptacle 12 are formed to bulge out as shown in FIG. 1, and hence to form three guide grooves 34 for guiding the connection of the male connector.

A retainer 40 is made e.g. of a synthetic resin and has a narrow plate-shaped base 41 for insertion into the retainer mount hole 26. Locking projections 42 are formed on the lower surface of the base 41 and correspond in number and location to the cavities 19 and terminal fittings 13. The locking projections 42 are formed on the lower surface of the base 41 and engage the terminal fittings 13 by projecting into the respective cavities 19. A mount-maneuvering projection 43 is provided on the upper surface of the rear end of the base 41 with respect to the inserting direction of the retainer 40 into the terminal accommodating portion 11. The mount-maneuvering projection 43 can be pushed from the side by a jig when the retainer 40 is to be mounted. A thin detach-maneuvering piece 44 is provided on the rear surface of the base 41 with respect to the inserting direction and can be pushed in a direction opposite to the insertion direction of the retainer 40 by a jig when the retainer 40 is to be detached. The side surface at the rear end of the retainer 40 with respect to the inserting direction is moderately arcuate.

Figure 8:
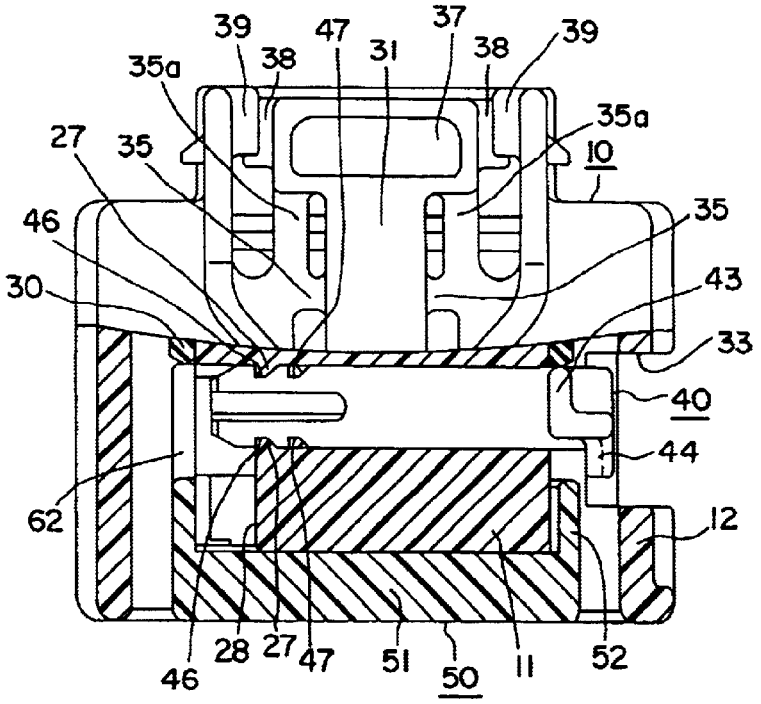
FIG. 8 is a section along 8—8 of FIG. 7.
Figure 10:
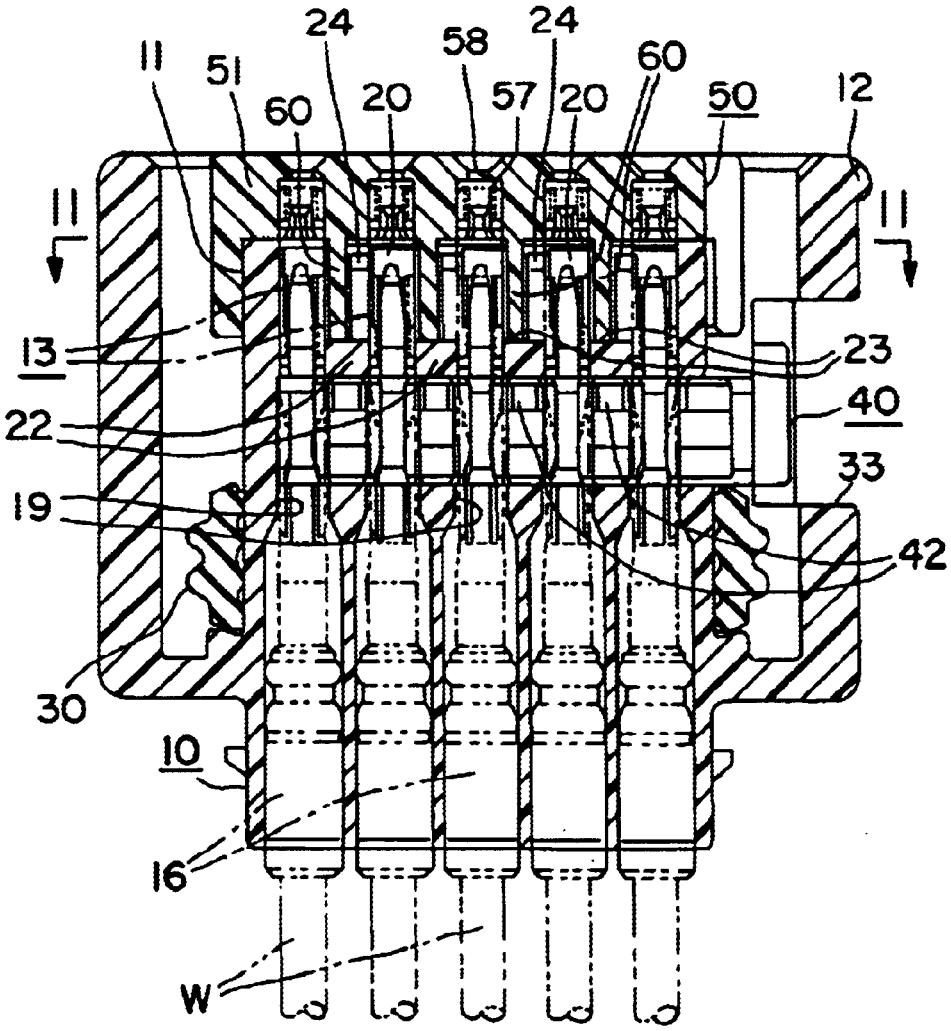
FIG. 10 is a section along 10—10 of FIG. 7.

Two first holding recesses 46 and two second holding recesses 47 are formed in this order in the lateral surfaces of the front side of the base 41 with respect to the inserting direction, as shown in FIG. 5. The retainer 40 can be held in a partial locking position or a full locking position in the terminal accommodating portion 11 by engaging the first holding recesses 46 or the second holding recesses 47 with the holding projections 27 in the retainer mount hole 26. Specifically, as shown in FIG. 8, the retainer 40 is held at the partial locking position when the first holding recesses 46 engage the holding projections 27. In this state, the respective locking projections 42 are retracted from the cavities 19 and are located substantially at the same positions as the partition walls 22, as shown in FIG. 10. Thus, insertion and withdrawal of the terminals 13 into and from the cavities 19 is permitted.

Figure 13:
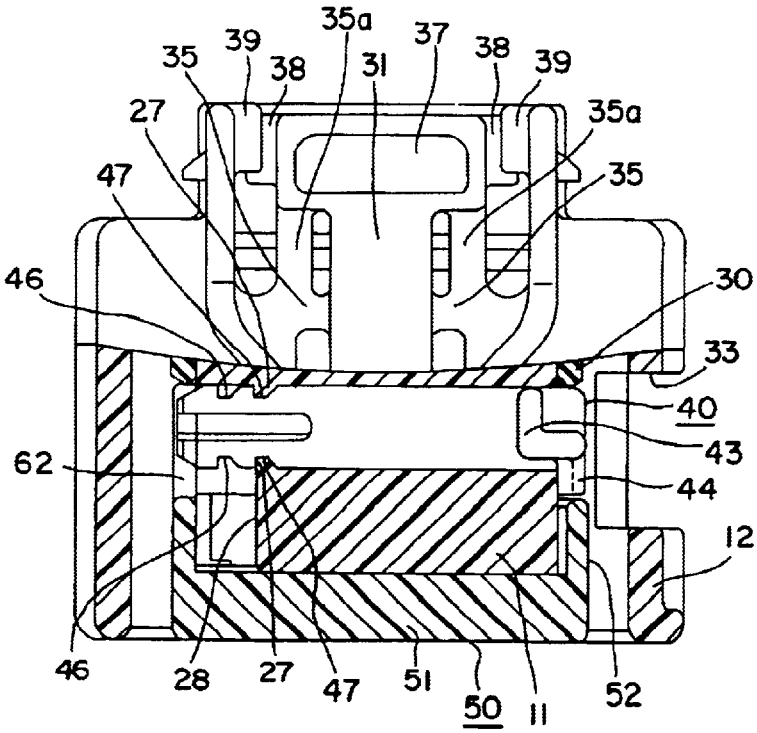
FIG. 13 is a section along 13—13 of FIG. 12.
Figure 14:
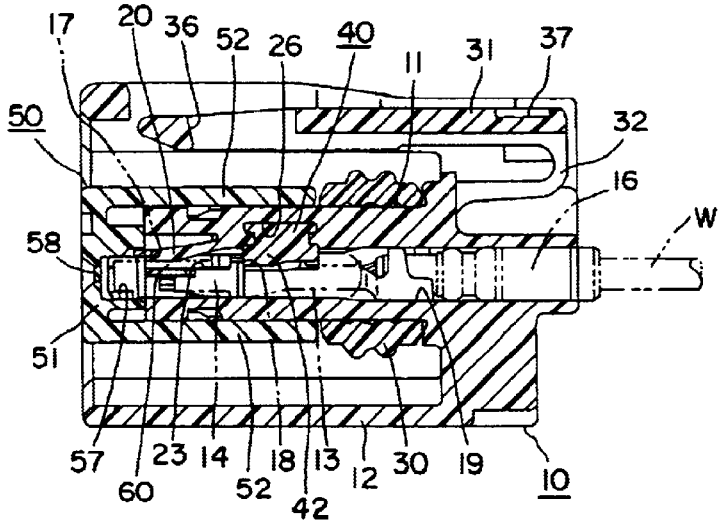
FIG. 14 is a section along 14—14 of FIG. 12.

The retainer 40 can be moved to the full locking position where the second holding recesses 47 are engaged with the holding projections 27 as shown in FIG. 13. In this state, the respective locking projections 42 enter the cavities 19 to engage the jaws 18 at the rear ends of the connecting portions 14 of the terminal fittings 13, as shown in FIG. 14. The locking projections 42 are slightly narrower than the partition walls 22. Thus, the locking projections 42 are engaged with the jaws 18 of the terminal fittings 13 substantially over the entire width.

Figure 6:
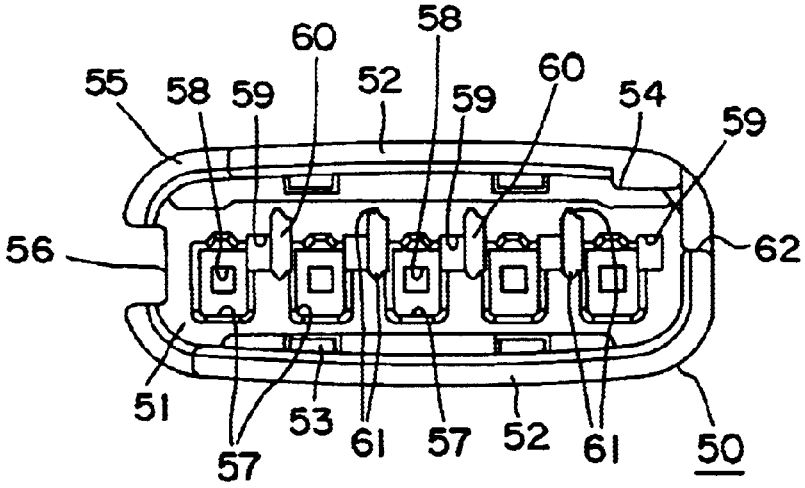
FIG. 6 is a rear view of the holder.
Figure 11A:
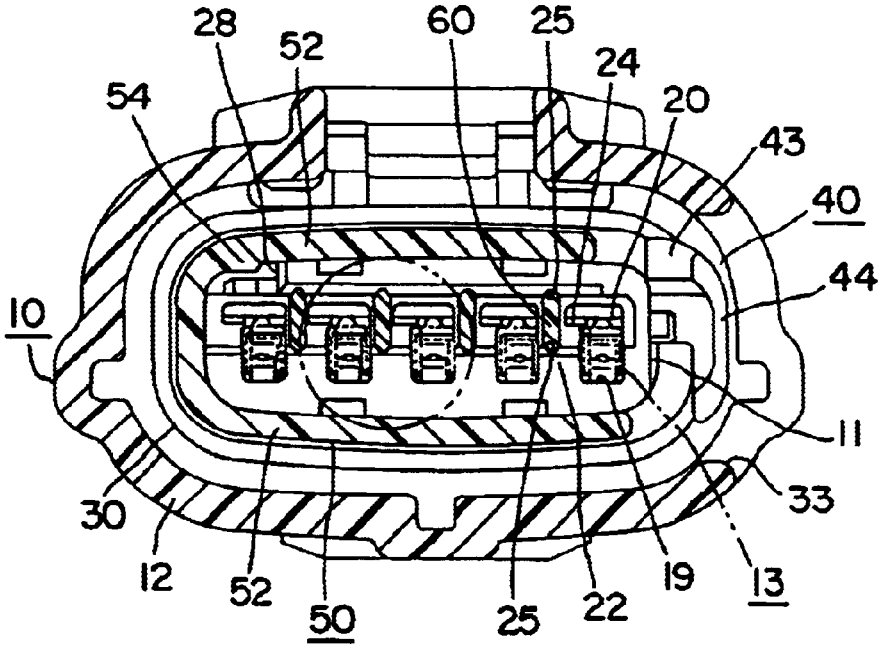
FIG. 11 is a section along 11—11 of FIG. 10.
Figure 11B:
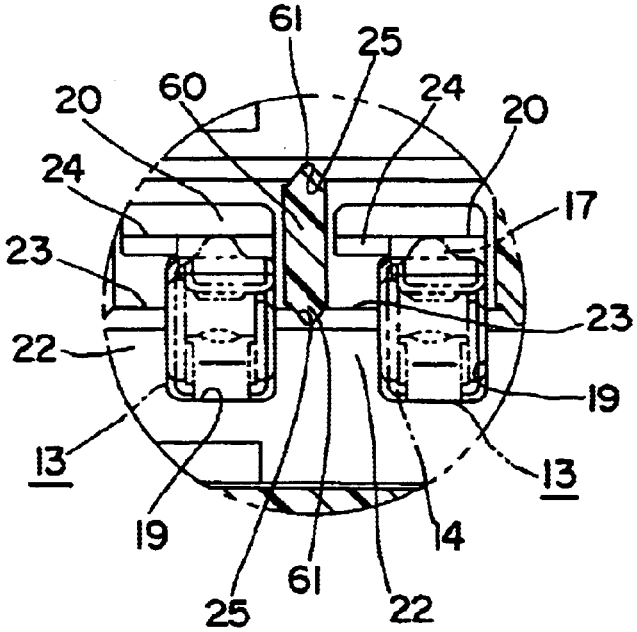
Figure 12:
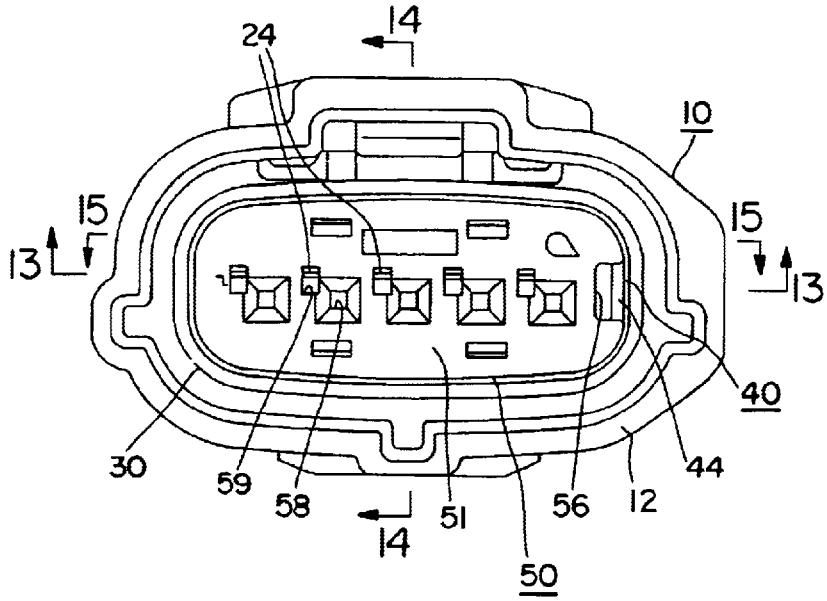
FIG. 12 is a front view showing a state where the retainer is at a full locking position.

A synthetic resin holder 50 has a substantially elliptical front wall 51, as shown in FIG. 6, and a substantially tubular holding plate 52 projects back from the front wall 51. The holding plate 52 is fittable on the outer surface of the terminal accommodating portion 11 as shown in FIG. 4, and two holding projections 53 are provided on each of the inner upper and lower surfaces of the holding plate 52. The holder 50 is held to the terminal accommodating portion 11 by engaging the holding projections 53 with the holding grooves 29 in the terminal accommodating portion 11. In this state, the holding plate 52 engages the front end surface of the rubber ring 30 to prevent the rubber ring 30 from coming out (see FIG. 9). A bulging portion 54 is provided at the inner surface of a right end portion of the upper part of the holding plate 52 in FIG. 6 and enters the mold-removal hole 28 of the terminal accommodating portion 11, as shown in FIG. 11. A communicating portion 55 opens sideways at the left end of the holding plate 52 in FIG. 6 and communicates with the retainer mount hole 26 and the retainer insertion hole 33. A jig insertion recess 56 is formed in the front wall 51 before the communication portion 55, as shown in FIG. 12, and allows the detach-maneuvering piece 44 of the retainer 40 at the full locking position to be exposed forward to outside and permits insertion of a jig to manipulate the detach-maneuvering piece 44. An escaping recess 62 is formed in the right side of the holding plate 52 as shown in FIG. 6 and is opposite the communicating portion 55 for escaping the leading end of the base portion 41 as shown in FIG. 8 when the retainer 40 is moved to its full locking position.

Figure 7:
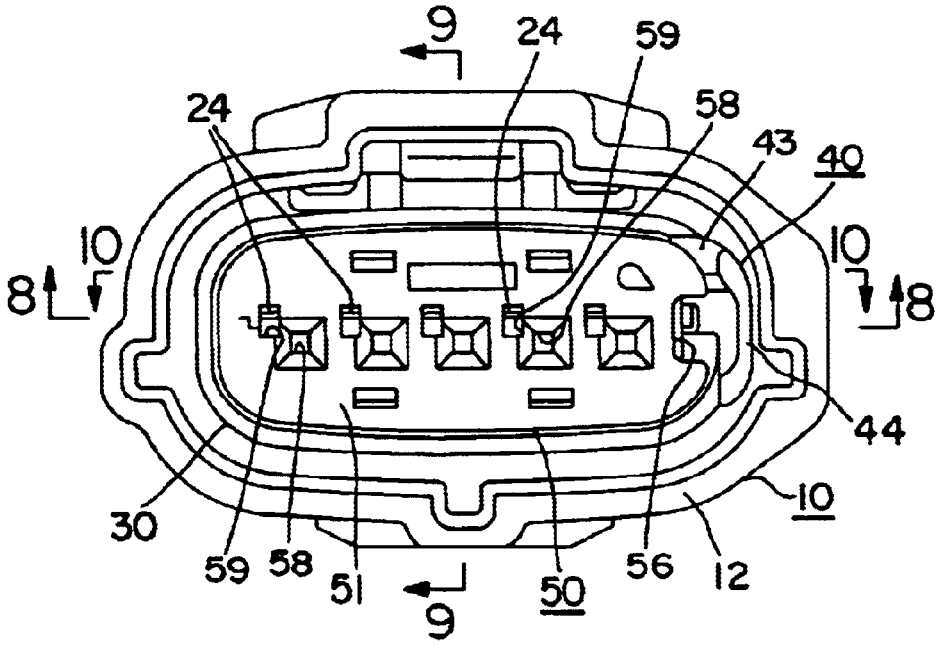
FIG. 7 is a front view showing a state where the retainer is mounted at a partial locking position on the housing in which the holder is mounted.

Fitting recesses 57 are formed substantially side-by-side in the front wall 51 of the holder 50 and align with the cavities 19, as shown in FIGS. 3 and 4. Thus, the fitting recesses 57 receive and support the front ends of the corresponding terminal fittings 13 that project forward from the terminal accommodating portion 11 to prevent loose movement of the terminal fittings 13 in vertical, lateral and forward directions. Insertion holes 58 are formed through the front wall 51 of the holder 50 in center positions of the respective fitting recesses 57, as shown in FIGS. 4 and 6. The insertion holes 58 accommodate the male terminal fittings of the mating male connector. Jig insertion holes 59 communicate with the upper right portions of the fitting recesses 57 in FIG. 6 and penetrate the front wall 51 longitudinally along the insertion direction ID. The jig insertion holes 59 expose the unlocking pieces 24 of the locks 20 and permit insertion of the jig from the front to manipulate the unlocking pieces 24, as shown in FIG. 7. The jig insertion holes 59 are displaced obliquely from the insertion holes 58. Thus, the male terminal fittings are unlikely to enter the jig insertion holes 59 erroneously even if the mating male connector is inclined during connection of the two connectors.

Four partition walls 60 project back from the rear surface of the front wall 51. Each partition wall 60 is disposed at the right side of a respective one of the jig insertion holes 59 and at the left side of the corresponding fitting recesses 57, as shown in FIG. 6. The partition walls 60 move along a partition insertion direction PID as the holder 50 is mounted on the terminal accommodating portion 11 and then enter the respective the notches 23, as shown in FIG. 11. The partition walls 60 can be inserted into the notches 23 until the rear ends of the partition walls 60 contact the back ends of the notches 23. Thus, the partition walls 60 completely close the notches 23. The partition walls 60 insulate the terminal fittings 13 in adjacent cavities 19 from each other, and side surfaces of the partition walls 60 form parts of the side surfaces of the cavities 19. The partition walls 60 are about half as wide as the partition walls 22, and are dimensioned to provide minimum clearances between the partition walls 60 and both the locks 20 and the unlocking pieces 24. More specifically, the left side surfaces of the partition walls 60 in FIG. 10 are recessed slightly from inner side surfaces of the fitting recesses 57 and the cavities 19. Thus, the partition walls 60 do not hinder deformation of the locks 20.

Substantially triangular positioning projections 61 extend up and down from upper and lower sides of each partition wall 60, as shown in FIG. 11. The positioning projections 61 engage in the V-shaped positioning grooves 25 in the notches 23 to position the partition walls 60 laterally. Small horizontal portions remain at the left sides of the upper and lower surfaces of the partition walls 60 in FIG. 11 adjacent the partitioning projections 61. These horizontal portions contact the upper and lower surfaces of the notches 23.

Figure 17:
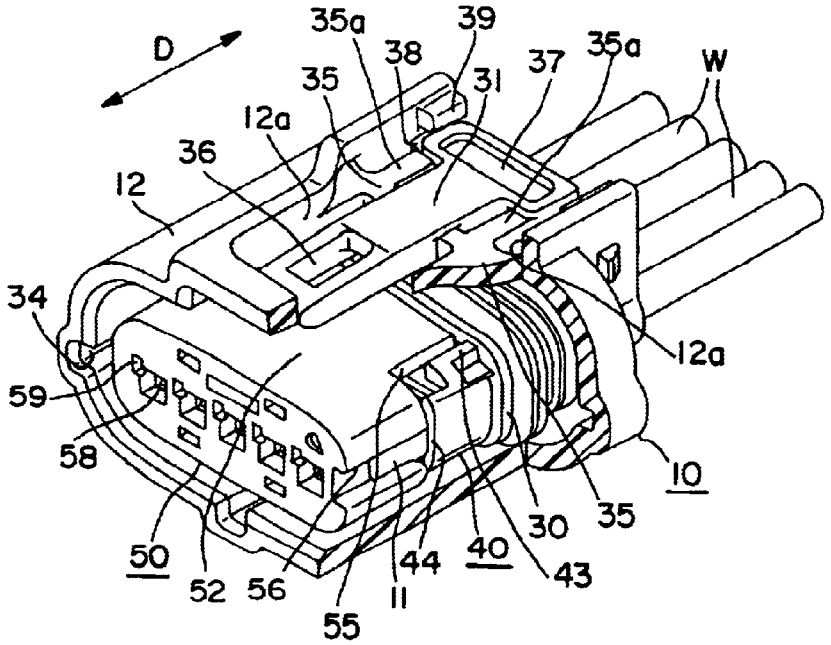
FIG. 17 is a perspective view partly cut away showing the female connector.

The lock arm 31 is a long narrow plate that extends longitudinally along forward and backward directions, as shown in FIG. 17. A lock hole 36 is formed in a front part of the lock arm 31, and a rear part of the lock arm 31 defines an operable portion 37 that is wider than the front part of the lock arm 31. The operable portion 37 can be pressed from above to deform the lock arm 31 resiliently or elastically.

Figure 20:
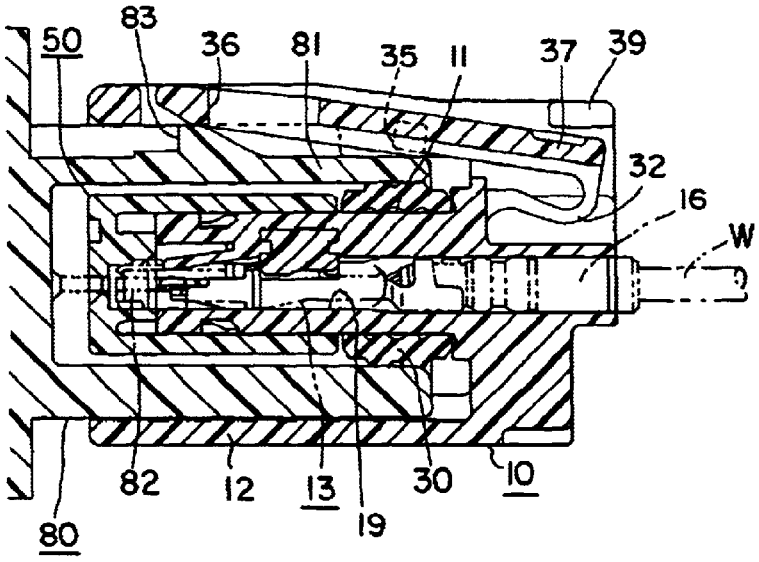
FIG. 20 is a side view in section showing a state where a lock arm is deflected while the two housings are being connected with each other.
Figure 21:
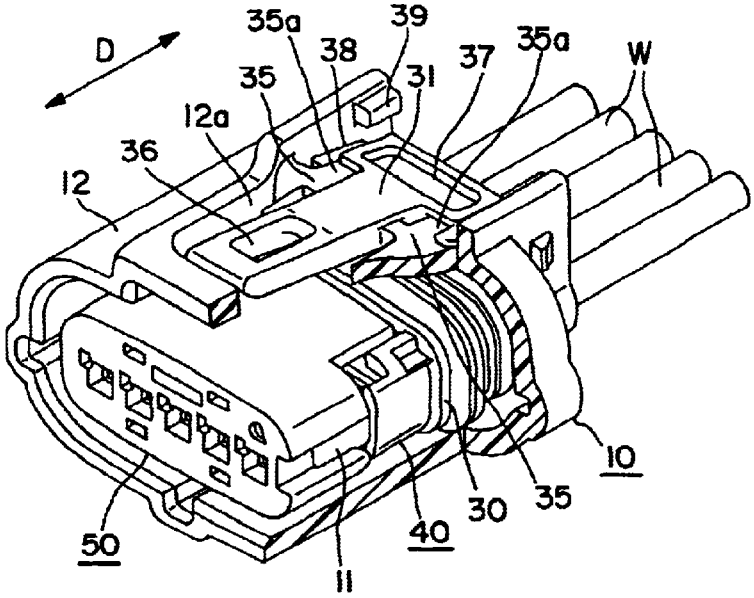
FIG. 21 is a perspective view partly cut away showing a state where the lock arm is deflected.

Supports 35 project laterally from opposite sides of the lock arm 31 at positions slightly behind the longitudinal center of the lock arm 31 and couple the lock arm 31 to surfaces 12*a* of the receptacle 12 that face the lock arm 31. Accordingly, the supports 35 are at least partly in the same plane as the lock arm 31. The lock arm 31 is resiliently or elastically deformable upward and downward like a seesaw about the supports 35 as shown in FIGS. 20 and 21. The supports 35 gradually widen towards the receptacle 12 for enhanced strength. Coupling portions 35*a* couple the rear ends of the supports 35 to front end surfaces of opposite sides of the operable portions 37 for enhancing resilient or elastic forces created when the lock arm 31 is deformed about the supports 35.

Figure 18:
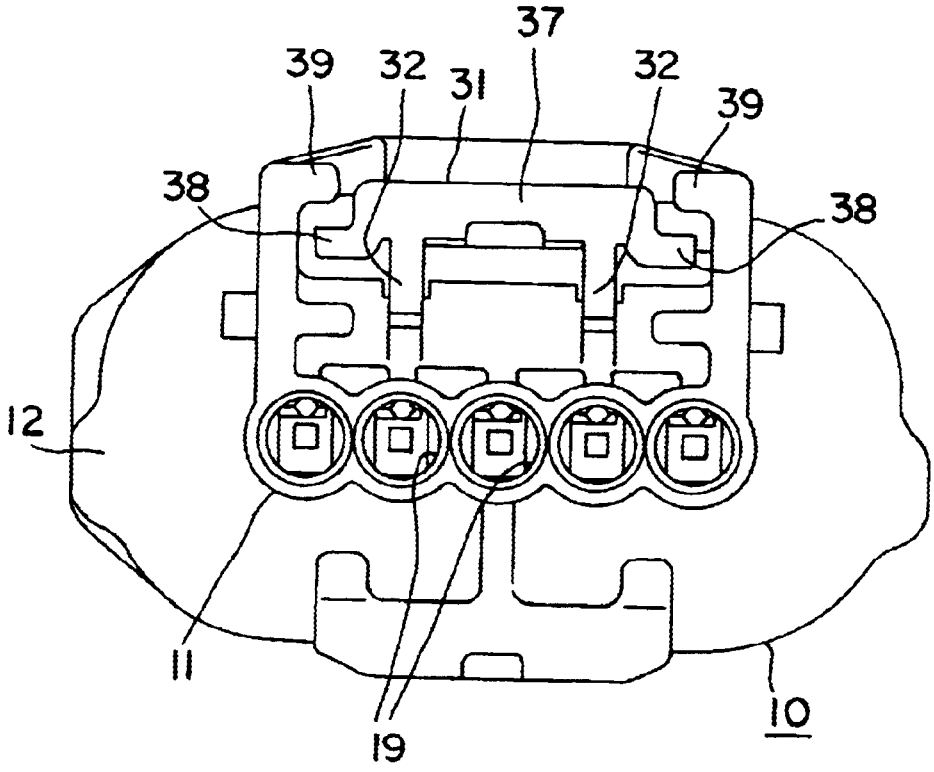
FIG. 18 is a rear view of the housing.
Figure 19:
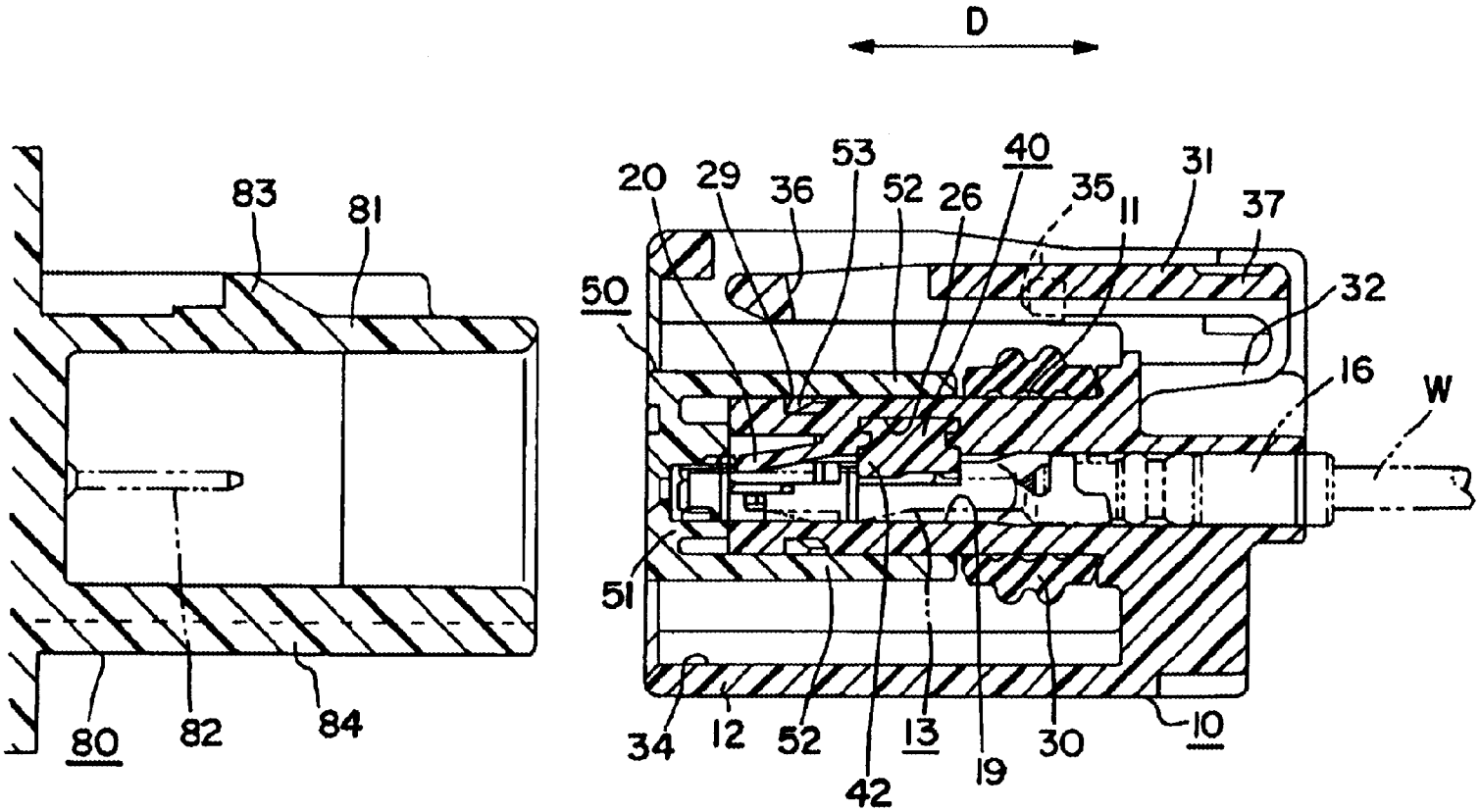
FIG. 19 is a side view in section showing a state before two housings are connected with each other.

Support arms 32 couple the opposite sides of the lower rear surface of the lock arm 31 to the upper rear surface of the terminal accommodating portion 11, as shown in FIGS. 18 and 19, so that the lock arm 31 can be supported resiliently or elastically. The support arms 32 preferably are long, narrow substantially rectangular beams that are bent in inverse L-shape when viewed sideways. Additionally, the support arms 32 are sufficiently resilient to accumulate a biasing force that will return the lock arm 31 to its natural unbiased state after a portion of the lock arm 31 behind the supports 35 has been displaced down. Thus, the support arms 32 are capable of enhancing the resilient force of the lock arm 31. The support arms 32 are formed to gradually widen toward the terminal accommodating portion 11 to achieve enhanced strength. The support arms 32 also prevent wires W and the like from entering and becoming caught between the terminal accommodating portion 11 and the lock arm 31.

Excessive-displacement restraints 38 project from the opposite side edges of the operable portion 37, as shown in FIG. 18. Receiving portions 39 project from the surfaces 12*a* of the receptacle 12 that face the lock arm 31 and are substantially opposed to each other at a positions above the respective restraints 38. The restraints 38 and the receiving portions 39 cooperate to prevent excessive upward displacement of the rear end of the lock arm 31.

The male connector has a housing 80 made e.g. of a synthetic resin. The housing 80 has a rectangular tube 81 that is fittable between the terminal accommodating portion 11 and the receptacle 12 of the female connector, as shown in FIG. 19. Five tab-shaped male terminal fittings 82 project from the back wall of the housing 80. The male terminal fittings 82 are at positions that correspond to the respective cavities 19 of the female connector, and are electrically connectable with the female terminal fittings 13 as the male and female connectors are connected. A locking projection 83 is provided substantially at a widthwise center of the upper surface of the tube 81 and substantially aligned with the lock arm 31. The locking projection 83 can enter the lock hole 36 in the lock arm 31 of the female connector to engage the front edge of the lock arm 36 when the connectors are properly connected with each other. Three guide ribs 84 project from the outer surface of the tube 81 for entering the guide grooves 34 and guiding the connection of the connector.

Figure 9:
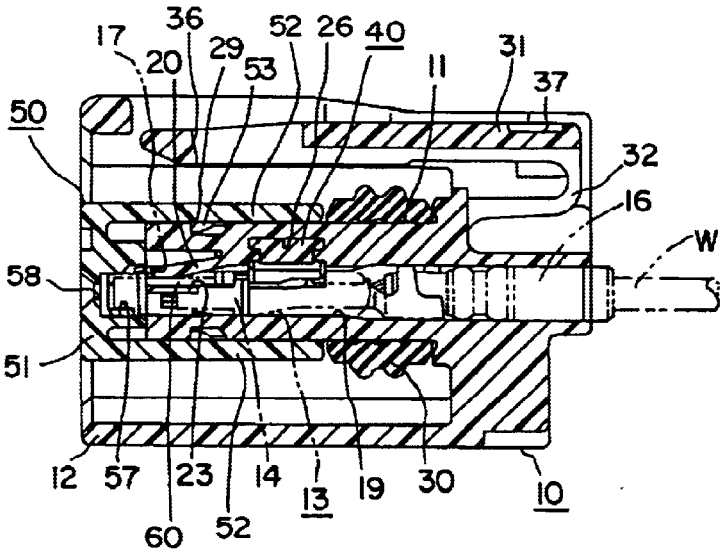
FIG. 9 is a section along 9—9 of FIG. 7.

The female connector is assembled by first mounting the rubber ring 30 on the outer surface of the terminal accommodating portion 11 of the housing 10 and then mounting the holder 50 on the terminal accommodating portion 11 from the front. The inner surface of the holding plate 52 then is fitted on the outer surface of the terminal accommodating portion 11. The holding projections 53 of the holding plate 52 move onto the slanted surfaces and enter the holding grooves 29, as shown in FIG. 9, and the front surfaces of the holding projections 53 engage the front surfaces of the holding grooves 29 to hold the holder 50 on the terminal accommodating portion 11. At this stage, the rear end of the holder 50 engages the front surface of the rubber ring 30 to hold the rubber ring 30 in position. During this process, the upper and lower positioning projections 61 of the partition walls 60 move in the partition insertion direction into the positioning grooves 25 of the corresponding notches 23, as shown in FIGS. 10 and 11. As a result, the partition walls 60 are inserted smoothly into the notches 23 and are positioned laterally to avoid interference with the locks 20 and the unlocking pieces 24. The partition walls 60 are inserted until their rear ends contact the rear ends of the notches 23 and align with the base ends of the locks 20. Consequently, the partition walls 60 partition adjacent cavities 19 and form the side surfaces of the cavities 19. In dill this state, the front surface of the holder 50 and the front surface of the housing 10 are substantially flush with each other.

The retainer 40 is inserted laterally through the retainer insertion hole 33 of the receptacle 12 and into the retainer mount hole 26 of the terminal accommodating portion 11. Insertion of the retainer 40 is stopped at the partial locking position with the first holding recesses 46 engaging the holding projections 27, as shown in FIG. 8. At this stage, the rear end of the retainer 40, with respect to the inserting direction, is between the holder 50 and the receptacle 12 and can be seen from the front. It does not matter which of the holder 50 and the retainer 40 is mounted first.

Figure 15:
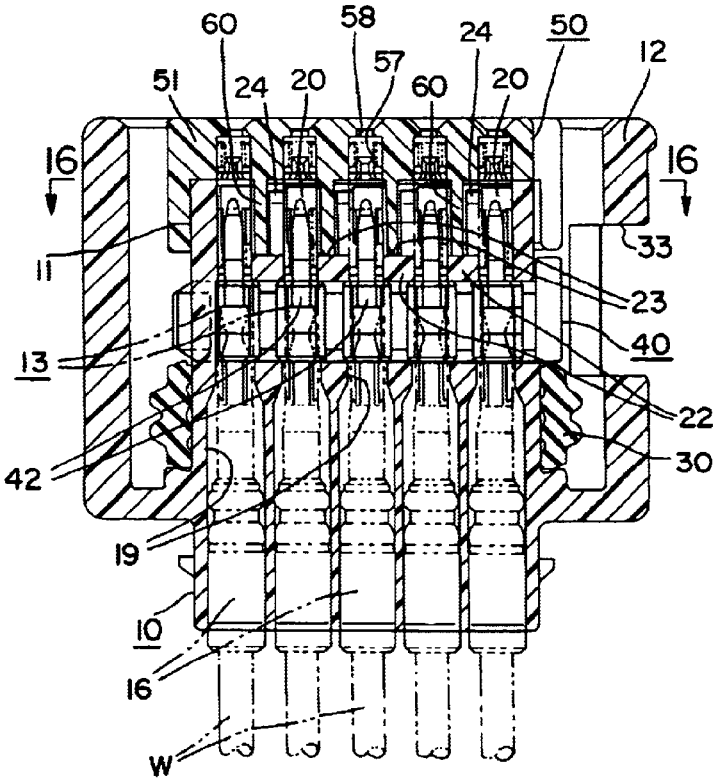
FIG. 15 is a section along 15—15 of FIG. 12.
Figure 16:
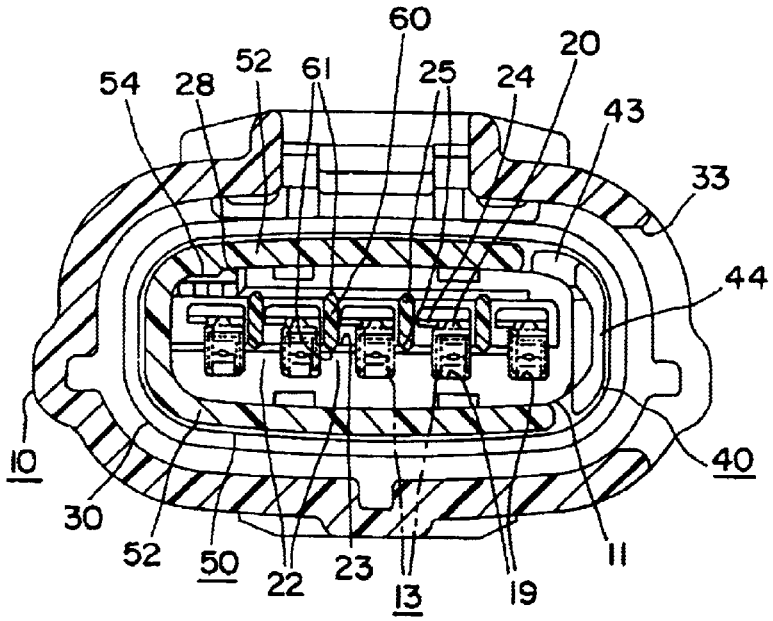
FIG. 16 is a section along 16—16 of FIG. 15.

Assembly proceeds by inserting the terminal fittings 13 into the cavities 19. Connecting portions 14 of the terminal fittings 13 push the locks 20 at an intermediate stage of insertion and deform the locks 20 into the deformation permitting spaces 21 above the cavities 19. The locks 20 are restored resiliently when the terminal fittings 13 reach a proper depth, and the restored locks 20 engage the engaging portions 17 of the terminal fittings 13, as shown in FIG. 9. Thus, the terminal fittings 13 are partially locked in the cavities 19. At this time, the front ends of the terminal fittings 13 are in the fitting recesses 57 of the holder 50, as shown in FIGS. 9 and 10. As a result, the terminal fittings 13 are supported and cannot move forward any further. The partition walls 60 close the notches 23, and hence the terminal fittings 13 are insulated from the terminal fittings 13 in adjacent cavities 19. A jig then can be inserted sideways through the retainer insertion hole 33 to push the mount-maneuvering projection 43 of the retainer 40. Thus, the first holding recesses 46 disengage from the holding projections 27 and the second holding recesses 47 engage the holding projections 27 to hold the retainer 40 at the full locking position shown in FIG. 13. In this position, the locking projections 42 of the retainer 40 project into the cavities 19 and engage the jaws 18, as shown in FIGS. 14 and 15, to lock the terminal fittings 13 redundantly.

All of the rear end of the retainer 40, except for the detach-maneuvering piece 44, becomes concealed by the holder 50 and cannot be seen from front when the retainer 40 reaches the full locking position. Thus, an operator can detect that the retainer 40 has reached the full locking position. In this state, the rear surface of the retainer 40, with respect to the inserting direction, is substantially flush with the side surface of the holder 50.

The female connector thus assembled is connected with the mating male connector, as shown in FIG. 19. More particularly, the tube 81 of the housing 80 of the male connector is inserted into the space between the terminal accommodating portion 11 and the receptacle 12 of the housing 10, and the front end of the lock arm 31 moves onto the locking projection 83, as shown in FIG. 20. Accordingly, the lock arm 31 undergoes a resilient or elastic pivotal deformation about the supports 35, such that portions before the supports 35 are displaced up and portions behind the supports 35 are displaced down (see FIG. 21).

Figure 22:
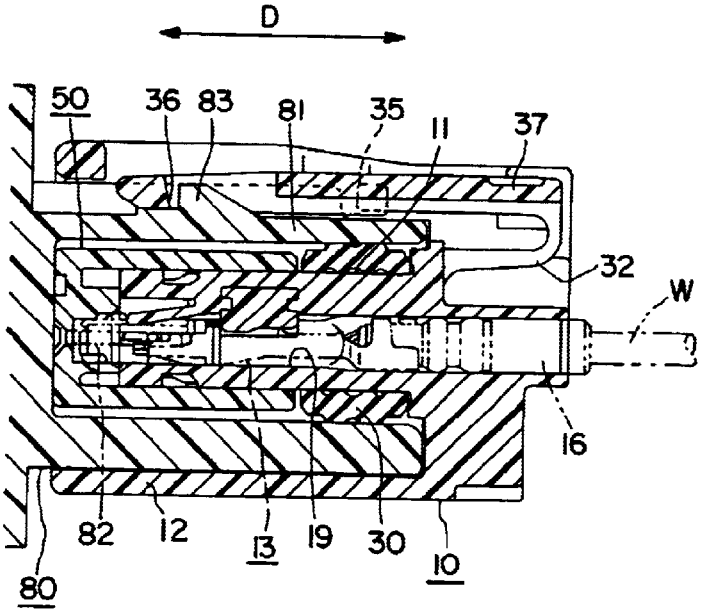
FIG. 22 is a side view in section showing a state where the two housings are properly connected with each other.

The pivoting of the lock arm 31 about the supports 35 urges the rear of lock arm 31 down and deflects the support arms 32. Thus, the support arms 32 accumulate a biasing force to return the lock arm 31. The front end of the lock arm 31 moves beyond the locking projection 83 when the connectors are connected to a proper depth, and the lock arm 31 returns substantially to its natural unbiased state. As a result, the locking projection 83 enters the lock hole 36 and engages the front edge of the lock hole 36, as shown in FIG. 22. In this way, the connectors are held securely together.

The support arms 32 resiliently support the rear end of the lock arm 31. Thus, the lock arm 31 is difficult to deform from its locking state and holds the housing 80 of the male connector with an enhanced force. In this state, the male and female terminal fittings 13, 82 are connected electrically, and the rubber ring 30 is squeezed between the inner surface of the tube 81 and the outer surface of the terminal accommodating portion 11, to provide a good watertight seal between the two connectors. The two connectors can be separated by pressing the operable portion 37 of the lock arm 31 to deform the lock arm 31. Thus, the locking projection 83 and the lock hole 36 can be disengaged from each other to separate the connectors.

The terminal fittings 13 can be detached for maintenance or another reason by first moving the retainer 40 from the full locking position to the partial locking position. The retainer 40 can be moved to the partial locking position by manipulating the detach-maneuvering piece 44 of the retainer 40 with a jig inserted through the jig insertion recess 56 of the holding member 50 from front. The lock 20 then is deformed and disengaged from the engaging portion 17 of the terminal fitting 13 by inserting a different jig into the jig insertion hole 59 of the holder 50 from front and pushing the unlocking piece 24 of the lock 20. The terminal fittings 13 then are pulled out of the cavity 19.

As described above, the lock arm 31 is coupled to the receptacle 12 by the supports 35. Thus, the freedom for positioning the supports 35 in a position different from the distal end portions of the lock arm 31 can be improved. Unlike the prior art, the pivot point of the lock arm 31 need not be moved to the rear end of the lock arm if the connector is shortened. Therefore, smaller connectors can be provided.

The two supporting arms 32 support the lock arm 31 resiliently. Thus, the housing 80 of the male connector can be held connected to the housing main body 10 with an enhanced force.

The invention is not limited to the above described and illustrated embodiment. For example, following embodiments also are embraced by the technical scope of the present invention. Beside the following embodiments, various changes can be made without departing from the scope and spirit of the present invention.

Figure 23:
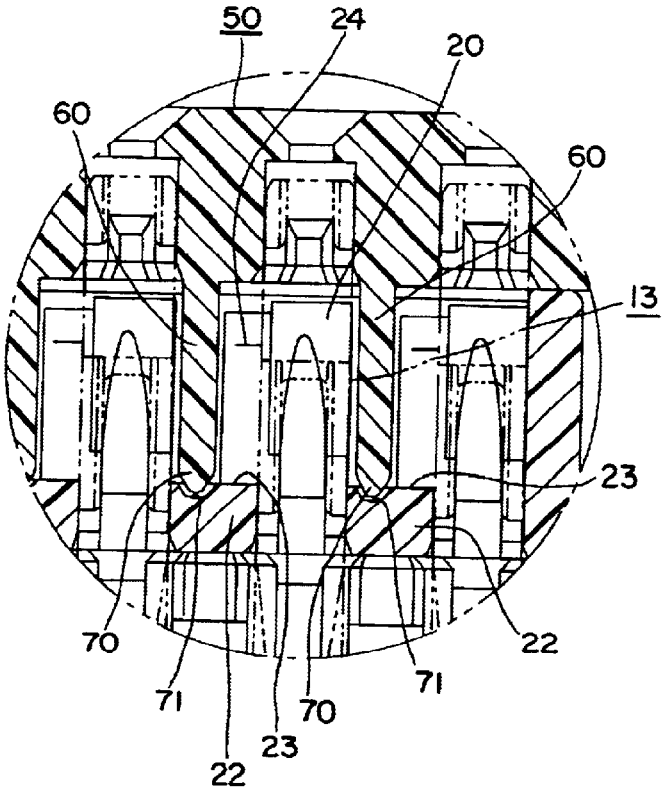
FIG. 23 is an enlarged plan view in section of a modification.
Figure 24:
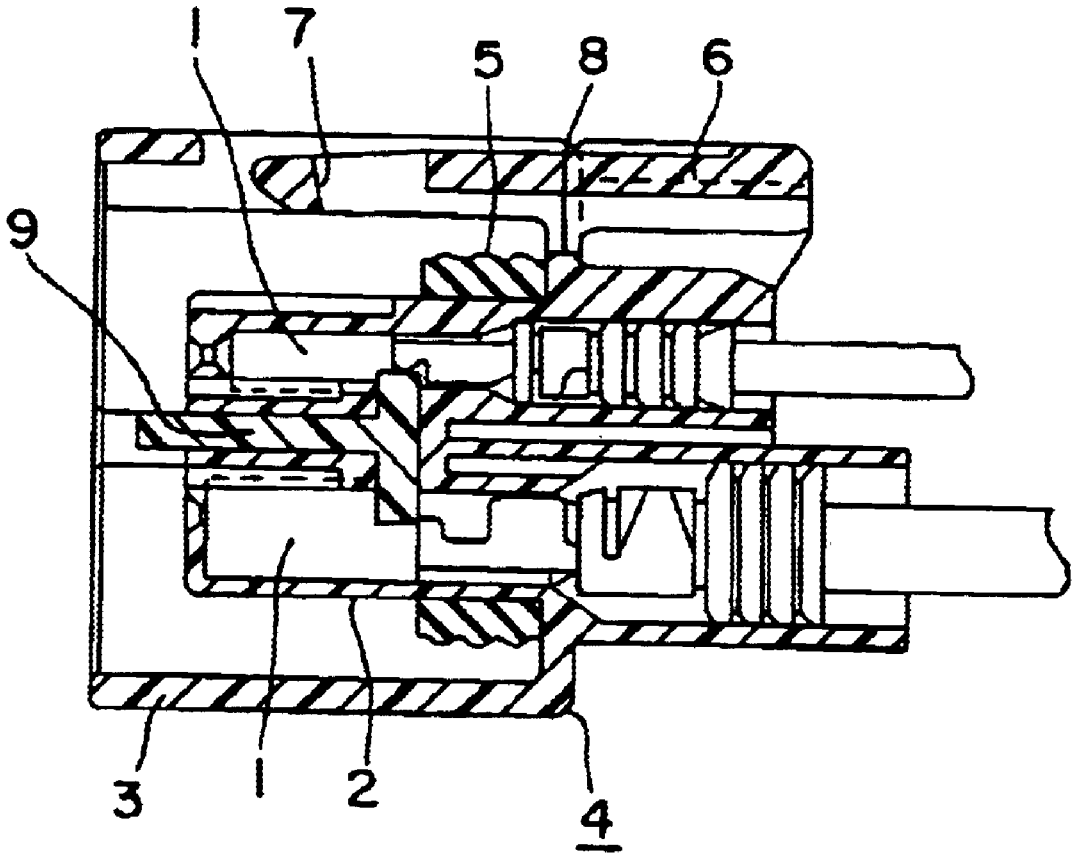
FIG. 24 PRIOR ART
FIG. 24 is a section of a prior art connector.

As a modification of the foregoing embodiment, protrusions 70 may project back from the rear ends of the partition walls 60 and recesses 71 for receiving the protrusions 71 may be formed in the back end surfaces of the notches 23, as shown in FIG. 23.

The partition walls 60 are formed with the substantially triangular positioning projections 61 that conform with the substantially V-shaped positioning grooves 25 in the foregoing embodiment. However, the positioning grooves 25 and the positioning projections 61 may be, for example, rectangular or semicircular. Further, positioning protrusions may be formed on the upper and lower surfaces of each notch 23 and the partition wall 60 may be positioned between two positioning protrusions according to the invention.

The holder 50 locks the rubber ring 30 in the foregoing embodiment. However the holder 50 also is applicable to a connector with no rubber ring.

Although the female connector has the receptacle 12, the present invention is also applicable to female connectors with no receptacle.

Although the female connector is described in the foregoing embodiment, the present invention is also applicable to male connectors.

Although the invention has been described with reference to a watertight connector, it is to be understood that the invention is also applicable to other types of connectors without waterproof function.

What is claimed is:

1. A connector having a housing comprising a terminal accommodating portion into which at least one terminal fitting is insertable, a receptacle at least partly surrounding the terminal accommodating portion, and a lock arm for holding a mating housing inserted between the terminal accommodating portion and the receptacle in a connected state with the housing, wherein the lock arm has a first surface facing the terminal accommodating portion, a second surface facing away from the terminal accommodating portion and first and second lateral sides extending between the first and second surfaces, the lock arm being coupled to the receptacle by first and second supports projecting laterally from the respective first and second lateral sides of the lock arm, such that the lock arm is resiliently deformable with the supports as pivot points.

2. The connector of claim 1, wherein the lock arm has opposite front end rear ends, and wherein the supports are provided in an intermediate position along the lock arm.

3. The connector of claim 1, wherein the supports gradually widen toward the receptacle.

4. The connector of claim 1, further comprising an excessive-displacement restraining means for preventing the lock arm from being excessively displaced.

5. The connector of claim 1, further comprising an auxiliary support for coupling a rear end of the lock arm to the terminal accommodating portion and resiliently supporting the lock arm.

6. The connector of claim 5, wherein the auxiliary support is gradually widened toward the terminal accommodating portion.

7. The connector of claim 5, wherein the auxiliary support is provided such that wires projecting from the terminal accommodating portion are substantially prevented from entering between the terminal accommodating portion and the lock arm.

8. The connector of claim 1, wherein the lock arm has an operable portion at an end thereof for selectively deflecting the lock arm.

9. The connector of claim 8, wherein the supports are coupled to the operable portion by coupling portions.

10. A connector having a housing comprising a terminal accommodating portion, cavities extending through the terminal accommodating portion for accommodating terminal fittings, a receptacle at least partly surrounding the terminal accommodating portion and having opposite front and rear ends, a space being defined between the terminal accommodating portion and the receptacle, said space being open at the front end of the receptacle for receiving a mating housing, and an elongated lock arm having opposite front and rear ends, the front end of the lock arm being configured for holding the mating housing inserted into the space between the terminal accommodating portion and the receptacle, the lock arm having a lower surface facing into the space between the terminal accommodating portion and the receptacle, an upper surface facing oppositely from the lower surface and opposite first and second lateral sides coupled respectively to the receptacle by first and second supports projecting laterally from the respective first and second lateral sides of the lock arm at locations intermediate the first and second ends of the lock arm, such that the lock arm is resiliently deformable about the supports.

11. The connector of claim 10, further comprising an excessive-displacement restraining means for preventing the lock arm from being excessively displaced about the supports.

12. A connector having a housing comprising a terminal accommodating portion, cavities extending through the terminal accommodating portion for accommodating terminal fittings, a receptacle at least partly surrounding the terminal accommodating portion and having opposite front and rear ends, a space being defined between the terminal accommodating portion and the receptacle, said space being open at the front end of the receptacle for receiving a mating housing, and an elongated lock arm having opposite front and rear ends, the front end of the lock arm being configured for holding the mating housing inserted into the space between the terminal accommodating portion and the receptacle, the lock arm having opposite first and second sides coupled respectively to the receptacle by first and second supports intermediate the first and second ends of the lock arm, such that the lock arm is resiliently deformable about the supports, the connector further comprising at least one auxiliary support coupling the rear end of the lock arm to the terminal accommodating portion and resiliently supporting the lock arm.

13. The connector of claim 12, wherein the at least one auxiliary support comprises two auxiliary supports.

* * * * *